United States Patent [19]

Nishikawa

[11] 4,415,254

[45] Nov. 15, 1983

[54] ELECTROPHOTOGRAPHIC COPYING APPARATUS WITH TRANSFER BIAS VOLTAGE STABILIZER

[75] Inventor: Masaji Nishikawa, Hachioji, Japan

[73] Assignee: Olympus Optical Company Ltd., Tokyo, Japan

[21] Appl. No.: 305,840

[22] Filed: Sep. 28, 1981

[30] Foreign Application Priority Data

Oct. 3, 1980 [JP] Japan ..... 55-137721

[51] Int. Cl.[3] ..... G03G 15/00

[52] U.S. Cl. ..... 355/3 TR; 355/14 TR

[58] Field of Search ..... 355/3 CH, 14 TR, 14 CH, 355/3 TR, 3 TE; 250/324–326; 361/213, 225, 229, 230

[56] References Cited

U.S. PATENT DOCUMENTS 4,184,870 1/1980 Suzuki ..... 355/3 TR

*Primary Examiner*—R. L. Moses

*Attorney, Agent, or Firm*—Weinstein & Sutton

[57] ABSTRACT

An electrophotographic copying apparatus includes a charge retaining member carried by a conductive member and on which an electrostatic latent image is formed. The latent image is developed with toner, and the toner image is transferred onto a record sheet by transfer means connected to a transfer bias source which is connected between the conductive member and the ground so that its terminal of the same polarity as the polarity to which the toner is charged is connected to the conductive member. A corona charger is disposed in opposing relationship with the charge retaining member. A high tension source is provided to cause a corona discharge from the corona charger. The high tension source has its one terminal connected to the conductive member and its other terminal connected to a corona discharge wire of the corona charger.

2 Claims, 9 Drawing Figures

ELECTROPHOTOGRAPHIC COPYING APPARATUS WITH TRANSFER BIAS VOLTAGE STABILIZER

BACKGROUND OF THE INVENTION

The invention relates to an electrophotographic copying apparatus, and more particularly, to such apparatus in which an electrostatic latent image formed on a charge retaining member such as an electrophotographic, photosensitive member is converted into a visual image by means of a toner and in which the toner image is transferred onto a record sheet by utilizing a transfer unit in the form of a transfer roller or transfer corona charger, thereby providing a copy.

A variety of such electrophotographic apparatus are known in the art, one form of which is illustrated in FIG. 1. The electrophotographic apparatus shown in FIG. 1 is adapted to produce the same reproduction on a plurality of record sheets by repeating only the developing and the transfer step with respect to an electrostatic latent image which is once formed on a charge retaining member. A sheet-shaped original 1 is placed on an inclined receptacle 2, and is fed in a direction indicated by an arrow a into an original feeder 3. The feeder 3 is formed by conveying rollers 4, 5 and delivers the original onto an original tray 6. In the meantime, the original 1 is illuminated by radiation from an illumination lamp 7, and the optical image of the original is projected by optics 8 onto a photosensitive drum 9. The drum 9 comprises a drum-shaped conductive member 9A which is connected to the ground potential, and a charge retaining member which may be formed by a photosensitive layer 9B of a material such as Se, for example, which is deposited on the surface of the conductive member 9A. The drum 9 is adapted to rotate in a direction indicated by an arrow b. After the drum surface is neutralized by radiation from a neutralizing lamp 10, a corona charger 11 charges the drum surface uniformly, which is then subject to an imagewise irradiation, thereby forming an electrostatic latent image on the photoconductive layer 9B. A Scorotron charger is used for the charger 11, which includes a grid 11A connected to a bias source 11B which supplies a voltage substantially equal to the potential to which the drum 9 is charged. The latent image on the drum surface may be developed with toner by means of a two component developing unit 12 of the dry type, for example. As the drum 9 rotates, the developed image is carried to a transfer station 13. It will be noted that the developing unit 12 is connected to a bias source 12A. On the other hand, a record sheet 15 which is contained in a stack within a cassette 14 is fed, one by one, by an oscillating and rotating pickup roller 16 to be conveyed along a feed path defined by rollers 17A and guide members 17B to be fed into the transfer station 13 in timed relationship with the rotation of the drum. In the transfer station 13, the record sheet is brought into overlapping relationship with the toner image, and is conveyed therealong to have the toner image transferred thereto by the action of a transfer unit 18. The transfer unit 18 may utilize a d.c. corona charger, but in the example shown, it comprises a biased roller transfer unit including a semiconductive transfer roller 20 connected to a bias source 19 and disposed for contact with the drum surface in order to effectively maintain an electrostatic latent image on the drum surface to enable a multiple copy operation. After passing through the transfer station 13, the record sheet continues to be conveyed while being held tightly against the drum surface. A separation claw 21 and an airstream to be described later cooperate to separate the record sheet from the drum surface so as to be conveyed along a guide member 17C which defines a record sheet conveying path 17. The sheet is then fed by conveying rollers 23 into a heat fixing unit 24 including electrical heaters where the toner is fixed. Subsequently, the sheet is carried away by delivery rollers 25 to be delivered onto a copy tray 26. It is to be understood that the rollers 17A and the guide members 17B, 17C which define the conveying path for the record sheet, and the separation claw 21 as well as the conveying rollers 23 are structurally connected to the ground potential in general. It is to be understood that the toner image on the drum surface is not completely transferred onto the record sheet, but part thereof remains on the drum surface. Such residual toner is scraped off by a rotating cleaner brush 27, and the removed toner is withdrawn into an airstream produced by the rotation of a fan 28 to be collected by a filter 29. It will be noted that both the cleaner brush 27 and the fan 28 are enclosed within a housing 30, which is provided to produce an effective amount of toner suction and to prevent a dispersion of the toner into the apparatus. Exhaust air from the fan 28 which does not contain the toner is introduced into a duct 31 and is discharged through a discharge port thereof which is located adjacent to the transfer station 13 for cooperation with the action of the separation claw 21 to separate effectively the record sheet from the drum surface. The cleaner brush 27 is rotatably mounted on an arm 33 which is in turn rotatably mounted on a support shaft 32 so that it may be moved away from the drum 9 during a multiple copy operation in which an electrostatic latent image which is once formed on the drum surface is repeatedly utilized to produce the toner image on a plurality of record sheets in succession through the repetition of only the developing and the transfer step. A trimming lamp 34 is interposed adjacent to the periphery of the photosensitive drum 9 and between the locations corresponding to the exposure and the developing step for removing the electric charge from a blind area, or an area of the photosensitive drum 9 which is located out of alignment with the record sheet 15 used. It is to be understood that the operation of the electrophotographic copying apparatus described above is controlled in accordance with the detection of the location of the original by means of switches 35, 36.

The described electrophotographic copying apparatus of the prior art has a disadvantage that the transfer efficiency of the toner image is greatly reduced to prevent a copy of a satisfactory quality from being obtained when the apparatus is operated under a high humidity condition or when a record sheet having a reduced resistivity due to the absorption of humid air is employed. Specifically, when the resistivity of the record sheet reduces because of the absorption of humid air, a current flow occurs to the guide members 17B, 17C which are located adjacent to the transfer station 13 and connected to the ground potential in response to the application of a bias voltage to the transfer unit. This causes a voltage drop to be developed across the resistance of the semiconductive transfer roller 20 to cause a reduction in the transfer voltage, preventing a proper transfer process from being effected. To eliminate such disadvantage, Japanese Laid-Open Patent Application No. 39,053/1976 proposes an arrangement for conveying a record sheet as shown in FIG. 2. Referring to FIG. 2, the arrangement includes a pair of d.c. sources 37, 38 connected between the guide members 17B, 17C, which are disposed adjacent to the transfer roller 20 (or transfer corona charger), and the ground so that a voltage of the opposite polarity from the polarity to which toner 39 is charged or of the same polarity as the transfer bias voltage be applied to the guide members 17B, 17C. With this arrangement, if the resistivity of the record sheet is reduced as by absorption of humidity, the application to the guide members 17B, 17C located adjacent to the transfer station 13 of a bias voltage of the same polarity as the transfer bias voltage prevents an undesired current flow through the record sheet 15 having a reduced resistivity, whereby a proper transfer voltage may be maintained in the transfer station 13 to assure a satisfactory transfer process. However, in order to maintain the record sheet 15 in contact with the guide members 17B, 17C having a bias voltage applied thereto, it is necessary that the bias voltage be applied to these members over an extensive area. This requires the insulation of these members from the body which assumes the ground potential, resulting in a complex construction. If the application of the bias voltage is limited to a region adjacent to the transfer station 13 in order to simplify the arrangement, stripe-like non-uniformity in the optical density of the copy results in response to a slight variation in the running path of the record sheet 15 from a predetermined path. If the dimension of the conveying path 17 is reduced as an attempt to assure a good contact between the record sheet 15 and the guide members 17B, 17C to which the bias voltage is applied, an increase in the probability of the occurrence of a paper jamming is experienced. Also, when the resistivity of the record sheet reduces, a charge injection to the drum 9 occurs not only through the transfer roller 20, but also through the members defining the record sheet conveying path and to which the bias voltage is applied and through the record sheet 15 having a reduced resistivity, thereby disadvantageously increasing the fogging in a non-image region as the transfer step is repeated during a multiple copy operation.

To eliminate the above disadvantages, the present inventor has already proposed an electrophotographic copying apparatus in which a main source of transfer bias is connected between a conductive member which supports a charge retaining member in the form of a photoconductive member and the ground in a manner such that a terminal of the source which is of the same polarity as the polarity of the toner charge is connected to the conductive member, and an auxiliary source of transfer bias is connected between the transfer roller and the ground in a manner such that a terminal of the auxiliary source which is of the opposite polarity from the polarity of the toner charge is connected to the transfer roller and in which at least part of the members which define the conveying path for the record sheet is connected to the ground potential, thereby automatically reducing the magnitude of the transfer bias voltage to prevent an undesired charge injection into a non-image region of the latent image whenever the resistivity of the record sheet decreases under a high humidity environment.

FIG. 3 illustrates essential parts of such an arrangement used in an electrophotographic copying apparatus. When the record sheet has a high resistivity as under a low humidity condition, a high transfer voltage is applied to the transfer station but when the resistivity of record sheet is reduced under a high humidity condition, the voltage applied to the transfer station is automatically reduced so as to supply a transfer voltage of a magnitude which is appropriate to the prevailing condition of the record sheet. Specifically, a main source of transfer bias 19A is connected between the conductive member 9A of the drum 9 and the ground, thereby applying a main transfer bias voltage to the conductive member 9A which is of the same polarity as the polarity to which toner 39 is charged. An auxiliary source of transfer bias 19B is connected between the transfer roller 20 and the ground to change the magnitude of the transfer bias voltage between high and low humidity conditions. To this end, an auxiliary transfer bias voltage which is of the opposite polarity from the polarity to which the toner 39 is charged is applied to the transfer roller 20 in a manner corresponding to a difference between the suitable magnitudes of the transfer voltage between the high and low humidity conditions. The rollers 17A and guide members 17B, 17C which define the conveying path 17 for the record sheet are connected to the ground at points adjacent to the transfer station 13. When such an arrangement is employed, if the record sheet 15 has a high resistivity as under a low humidity condition, the magnitude of a current flow through the record sheet 15 to the rollers 17A and the guide members 17B, 17C, which are connected to the ground, will be minimal and negligible. Hence, the transfer voltage applied to the transfer station 13 will be the sum of the main bias voltage applied to the conductive member 9A and the auxiliary bias voltage applied to the transfer roller 20. By contrast, when the record sheet 15 has absorbed humidity under a high humidity condition, its resistivity will be greatly reduced, and there occurs a current flow therethrough to the rollers 17A and guide members 17B, 17C, which are connected to the ground, developing a voltage drop across the semiconductive coating on the transfer roller 20, whereby the surface potential of the transfer roller 20 will be substantially equal to the ground potential. Thus, the transfer voltage is reduced by the magnitude of the auxiliary bias voltage applied to the transfer roller 20 as compared with the value prevailing under a low humidity condition. Accordingly, by choosing the magnitude of the auxiliary bias voltage to be equal to a difference between the magnitudes of the transfer voltages which are appropriate under high and low humidity conditions, an optimum transfer voltage is maintained for any variation in the resistivity of the record sheet 15 during a multiple copy operation.

As shown in FIG. 3, a variable or fixed additional resistor 41 may be connected in the bias circuit associated with the transfer roller 20 where it is necessary to adjust the magnitude of the auxiliary bias voltage applied to the transfer roller 20 because the record sheet 15 has an intermediate value of resistivity or where a variation in the resistance of the transfer roller 20 which occurs as a result of manufacturing tolerances should be compensated for. By experiment, it is found that the additional resistor may have a resistance in a range from several tens to several hundreds of megohms. However, the resistance is not limited to this range since it depends on the pressure of contact between the drum 9 and the transfer roller 20.

When the main bias voltage is applied to the drum 9, it is necessary to change the polarity and the magnitude of voltages of the bias source 11B connected to the grid 11A of the Scorotron charger 11 and developing bias source 12A connected to the developing unit 12, in a manner as illustrated in FIG. 4. It should be understood that various bias voltages are determined so that the potential difference between the grid 11A and the developing unit 12 on one hand and the conductive member 9A on the other is equal to the value prevailing in the electrophotographic copying apparatus shown in FIG. 1.

When an electrophotographic copying apparatus is used having various bias voltages applied as shown in FIG. 4, it will be apparent from the description given above in connection with FIG. 3 that a plurality of copies having satisfactory quality and which are free from non-uniformity in the optical density can be obtained from the single latent image if the resistivity of the record sheet 15 decreases as a result of absorption of humidity. However, this arrangement involves an inconvenience that an adjustment of the transfer bias voltage or a fluctuation thereof for some reason also causes a change in the potential difference between the grid 11A of the Scorotron charger 11 or the developing unit 12 and the conductive member 9A of the drum 9. Consequently, the original values must be reestablished by adjusting the voltages of the sources 11B, 12A. Such inconvenience can be overcome by the use of a bias supply circuit which has been also developed by the present inventor. Such a bias supply circuit is illustrated in FIGS. 5 and 6.

The bias supply circuit shown in FIG. 5 derives a variety of bias voltages, including both positive and negative voltages with respect to the ground potential, from a single d.c. source by utilizing resistive voltage dividers and a constant voltage circuit. It is designed to prevent any substantial change in the potential difference between other members, to which bias voltages are applied, and the conductive member if the magnitude of the main bias voltage applied to the conductive member of the photosensitive drum changes or fluctuates. In FIG. 5, a voltage divider including a variable resistor 46, fixed resistor 47 and variable resistor 48 is connected across a d.c. source 45, with the junction between the resistors 47, 48 being connected to the ground. Consequently, as viewed from the ground potential, a negative potential is derived toward the resistor 46 while a positive potential is derived toward the resistor 48. The variable resistor 46 has a movable tap 46A, the output voltage of which is supplied to the conductive member 9A of the photosensitive member 9 as a main source of transfer bias 19A. By moving the movable tap 46A, the magnitude of the main bias voltage can be changed. A constant voltage circuit 49 is connected across the movable tap 46A and the ground so as to be fed with the main bias voltage. A voltage divider including a fixed resistor 50 and a variable resistor 51 is connected to the constant voltage output of the circuit 49 in order to supply an output voltage, derived at the junction between the resistors 50, 51, to the Scorotron charger grid 11A as a source of bias voltage 11B. By adjusting the variable resistor 51, the magnitude of such output voltage can be changed. Another voltage divider including a fixed resistor 52 and a variable resistor 53 is also connected to the constant voltage output of the circuit 49 to supply an output voltage, derived at the junction between the resistors 52, 53, to the developing unit 12 as a source of developing bias 12A. The value of such voltage can also be changed by adjusting the variable resistor 53. A source of auxiliary transfer bias 19B which is connected to the transfer roller 20 is formed by the junction between a fixed resistor 54 and a variable resistor 55, which form a voltage divider connected across the variable resistor 48. In this manner, the magnitude of the auxiliary bias voltage can be changed independently from other bias voltages, by adjusting the variable resistor 55.

In the bias supply circuit shown in FIG. 5, when the tap 46A of the resistor 46 is changed, the output voltage of the main bias source 19A changes. However, since the output voltage of the constant voltage circuit 49 which operates on the basis of the reference voltage, defined by the output voltage from the bias source 19A, also changes automatically by an equal amount with respect to the ground potential, so that there is produced no difference between the voltage of the bias sources 11B, 12A which are developed on the basis of the output voltage from the constant voltage circuit 49 and the voltage from the main bias source 19A. In addition, the magnitude of the voltage from the auxiliary bias source 19B can be independently adjusted by adjusting the variable resistor 55. In this manner, an adjustment of the magnitude of the voltages from the various bias sources can be adjusted without affecting the values established for the other bias sources. In other words, a single adjustment is enabled. It should be understood that the resistive voltage dividers and the constant voltage circuit can be modified in a number of ways. By way of example, the resistive voltage divider associated with the auxiliary bias source 19B may include a movable tap on the variable resistor 48 so that an output voltage may be derived therefrom. Also, the constant voltage circuit 49 may utilize a Zener diode or a discharge tube either alone or in combination with transistors, thus allowing an effective utilization of various known circuit arrangements.

The bias supply circuit shown in FIG. 6 differs from that shown in FIG. 5 in that the constant voltage circuit is replaced by a pair of ganged variable resistors 56, 57 of an equal resistance which is connected in series across the d.c. source 45. In this arrangement, the combined resistance of the voltage divider including the resistors 56, 47, 57 and 48 may be chosen small to permit a current flow of a relatively high magnitude to pass therethrough. In this manner, a variation which occurs in the magnitude of such current flow in response to current flows to or from the bias sources 11B, 12A, 19A and 19B can be reduced. By adopting an arrangement such that the combined resistance across the taps 56A, 57A on the ganged variable resistors 56, 57 be maintained constant, a substantially constant current flow can be established in the circuit portion from the resistor 56 to the resistor 48, thus maintaining the constant magnitude of voltage across the taps 56A, 57A. Such a simplified constant voltage circuit is effectively applicable to the electrophotographic copying apparatus shown in FIG. 4, presenting a practical utility.

It will be appreciated that by utilizing the described bias supply circuit, the potential difference between the conductive member 9A of the photosensitive drum 9 on one hand and the grid 11A of the Scorotron charger 11 and the developing unit 12 on the other can be maintained constant irrespective of any adjustment or fluctuation of the transfer bias voltage.

In the arrangements of FIGS. 3 to 6, the provision of the auxiliary source of transfer bias 19B is not essential, but the transfer roller 20 may be connected to the ground either directly or through a resistor. This allows a normal transfer voltage to be maintained if the resistivity of the record sheet 15 decreases by the absorption of humidity, since the members defining the conveying path 17 assume the ground potential. In this instance, when the record sheet 15 exhibits a low resistivity, the transfer roller 20 will function merely as means for holding the record sheet 15 tightly against the drum surface. By contrast, when the record sheet 15 is in its dry condition to exhibit an increased sensitivity, the potential assumed by the record sheet 15 will be independent from the potential of the members defining the conveying path 17, but will be solely affected by the potential of the transfer roller 20 which is then equal to the ground potential, so that a transfer voltage can be maintained which is of the same magnitude prevalent when the record sheet 15 absorbs the humidity to exhibit a reduced resistivity.

An electrophotographic copying apparatus previously developed by the present inventor has been described above in connection with FIGS. 3 to 6. In this apparatus, the charger 11 may be constructed in a manner as indicated in FIG. 7 where corona discharge wire 11C is connected to one end of a high tension source 11D for corona discharge, the other end of which is connected to the ground, thereby uniformly charging the photosensitive drum 9. In FIG. 7, an output impedance of the high tension source 11D and the transfer bias source 19A is indicated by resistors 61, 62, respectively. In this instance, a current, indicated by arrow Ic shown in broken lines and which charges the photosensitive drum 9, flows through a path including the high tension source 11D, the discharge wire 11C, photosensitive drum 9, transfer bias source 19A and the ground, with the transfer bias voltage applied across the drum 9 and the ground being determined by the e.m.f. of the transfer bias source 19A and the voltage drop developed across the resistor 62. When no corona discharge takes place, the current flow through the resistor 62 is supplied by the developing current and the current flow from the transfer roller, but has a magnitude less than several microamperes. However, when the corona discharge takes place, the current Ic flowing through the resistor 62 has a magnitude which is from several tens to several hundreds of microamperes, and exhibits the maximum magnitude operating on the resistor 62 to develop a voltage drop thereacross. Consequently, if the high tension source 11D is connected in the manner shown in FIG. 7, the transfer bias voltage fluctuates in accordance with the presence or absence of the corona discharge, causing a corresponding change in the transfer performance. Hence, a desired uniform transfer effect cannot be expected by accommodation for a change in a humidity condition of the record sheet. In addition, the effective voltage across the photosensitive drum 9 and other devices, such as the corona voltage, the Scorotron grid voltage and the developing bias voltage, also change, presenting a difficulty that a uniform charging potential or developing bias potential cannot be maintained. Such difficulty can be overcome by providing a source of transfer bias 19A which has a reduced output impedance, which however requires an increased output current capacity for the source 19A, resulting in an increased size thereof.

SUMMARY OF THE INVENTION

It is an object of the invention to eliminate the described disadvantages while maintaining the advantages of an electrophotographic copying apparatus which has been already developed by the present inventor and described above in connection with FIGS. 3 to 6, by providing an electrophotographic copying apparatus of the type in which a main transfer bias voltage, utilized for the purpose of transferring a toner image, is applied to a conductive member which supports a charge retaining member and wherein a high tension source used to cause a corona discharge from a corona charger has its one terminal connected to the conductive member to which the transfer bias voltage is applied and its other terminal connected to a corona discharge wire.

In accordance with the invention, the corona current which operates upon the charge retaining member cannot flow into the source which applies the transfer bias to the conductive member, so that a variation in the magnitude of the transfer bias voltage applied to the conductive member is avoided as the high tension source is switched on and off or in response to a fluctuation of the corona current. In this manner, the transfer bias voltage applied across the conductive member and the ground can be maintained substantially constant.

DESCRIPTION OF PREFERRED EMBODIMENT

Figure 8:
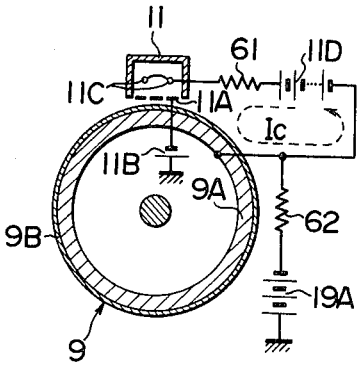
FIG. 8 is a diagrammatic cross section illustrating the manner of connection of a corona charger in an electrophotographic copying apparatus according to one embodiment of the invention.

FIG. 8 is a diagrammatic view of the circuit arrangement of a corona charger in an electrophotographic copying apparatus according to one embodiment of the invention. The embodiment is implemented in an electrophotographic copying apparatus as described above in connection with FIGS. 3 to 6. A high tension source 11D to cause a corona discharge from a Scorotron charger 11 has its one terminal connected to the conductive member 9A of a photosensitive drum 9 to which a transfer bias source 19A is connected, and has its other terminal connected to a corona discharge wire 11C. Resistors 61 and 62 represent the output impedance of the high tension source 11D and the transfer bias source 19A, respectively, as before. In this arrangement, a current Ic indicated by an arrow shown in broken lines which charges the photosensitive drum 9 flows from the terminal of the source 11D which is connected to the discharge wire 11C, through the conductive member 9A of the drum 9 to return to the other terminal of the source 11D, but cannot flow into the bias source 19A through the resistor 62. Accordingly, the bias voltage which is applied to the drum 9 from the bias source 19A can be maintained in a very stable manner without being influenced by the presence or absence of a corona discharge, thus allowing a stable transfer performance to be maintained. At the same time, various voltages which effectively act between the drum 9 and associated devices, such as the corona voltage, the Scorotron grid voltage and the developing voltage can also be maintained at desired values. The current flow through the resistor 62 will be on the order of less than several microamperes if the developing current and the current flow from the transfer roller are taken into consideration. Consequently, the bias source 19A may have a small output current capacity.

Figure 1:
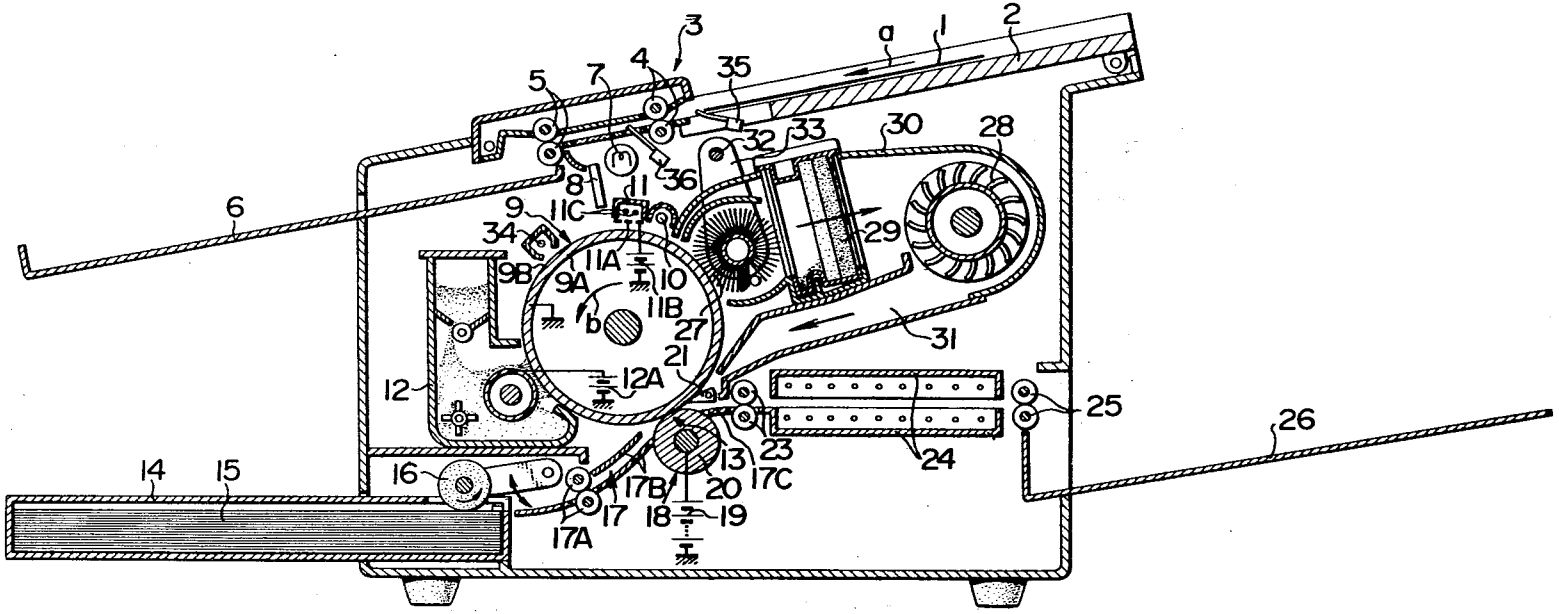
FIG. 1 (PRIOR ART)
FIG. 1 is a cross section of one form of conventional electrophotographic copying apparatus.
Figure 2:
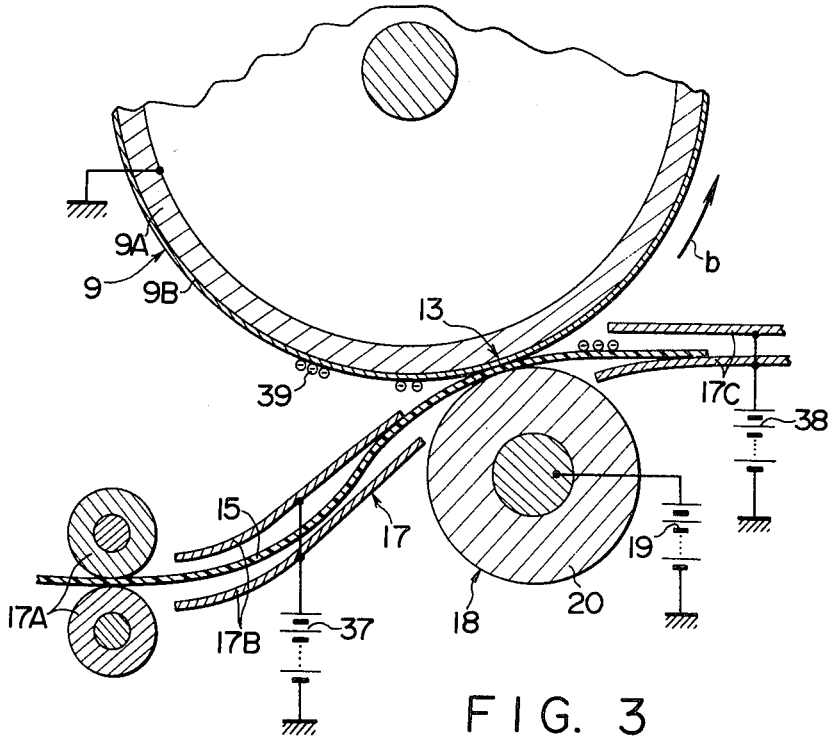
FIG. 2 (PRIOR ART)
FIG. 2 is an enlarged cross section of part of another form of conventional electrophotographic copying apparatus.
Figure 3:
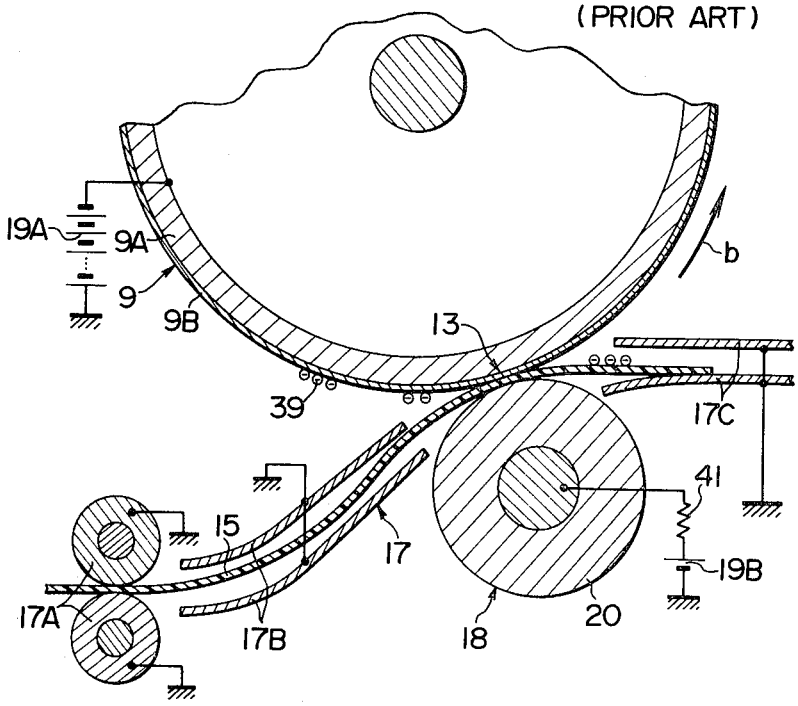
FIG. 3 (PRIOR ART)
FIG. 3 is an enlarged cross section of part of an electrophotographic copying apparatus which has been previously proposed by the present inventor.
Figure 4:
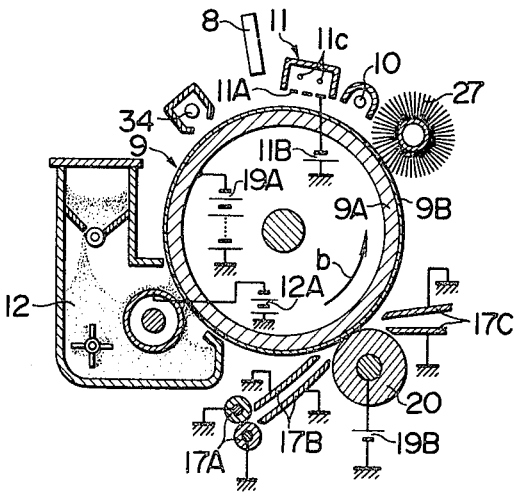
FIG. 4 (PRIOR ART)
FIG. 4 is a cross section of part of the electrophotographic copying apparatus shown in FIG. 3.
Figure 5:
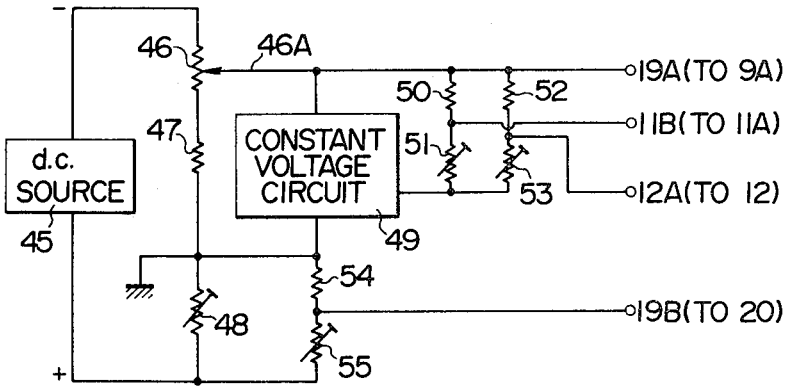
FIG. 5 (PRIOR ART)
FIGS. 5 and 6 are circuit diagrams of a bias supply circuit which is preferred for use in the apparatus shown in FIG. 4.
Figure 6:
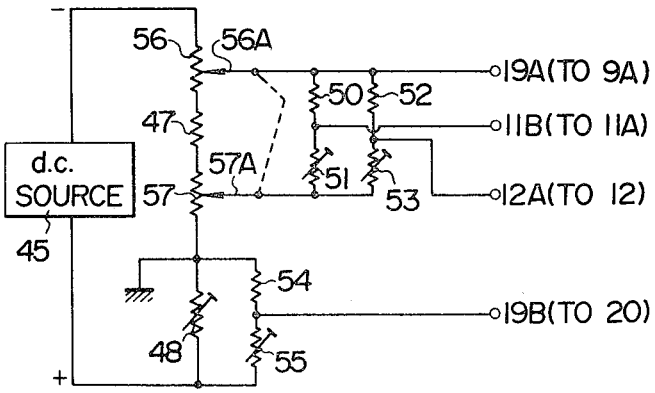
FIG. 6 (PRIOR ART)
Figure 7:
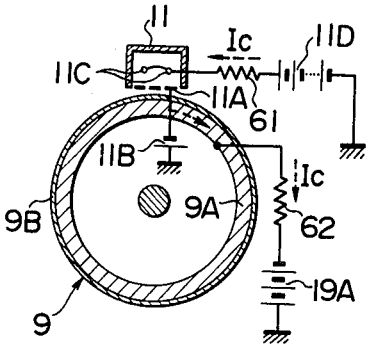
FIG. 7 (PRIOR ART)
FIG. 7 is a diagrammatic cross section illustrating a conventional manner of connection of a corona charger.
Figure 9:
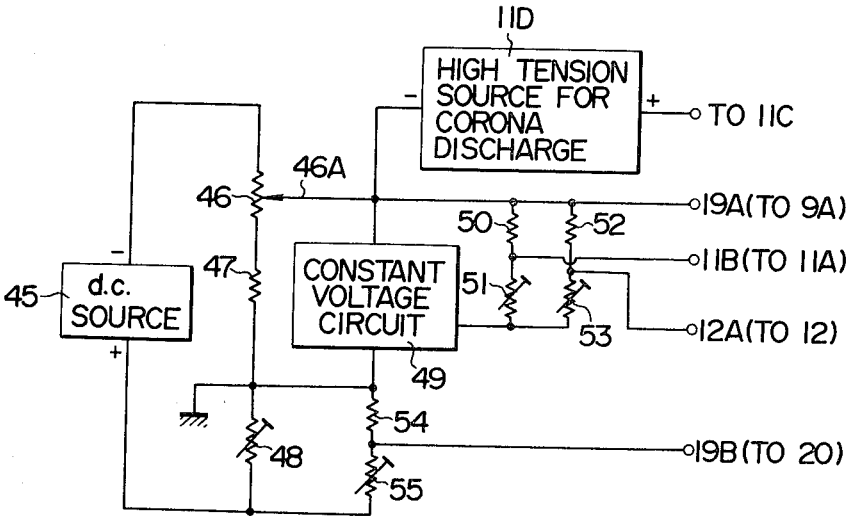
FIG. 9 is a circuit diagram of a bias supply circuit which is preferred for use in the apparatus shown in FIG. 8.

FIG. 9 shows a power supply circuit similar to the bias supply circuit shown in FIG. 5 and to which the high tension source 11D is connected. It is to be understood that corresponding parts are designated by like reference characters as before. The negative terminal of the high tension source 11D is connected to a movable tap 46A which is in turn connected to the conductive member 9A of the photoconductive drum 9 while the positive terminal is connected to the corona discharge wire 11C of the Scorotron charger 11. Where an auxiliary source of transfer bias 19B is not used, the positive terminal of a d.c. source 45 may be connected to the ground.

It should be understood that the invention is not limited to the particular embodiment disclosed above, but that a number of changes and modifications are possible therein. By way of example, while the invention has been applied to the Scorotron charger for uniform charging in the described embodiment, the invention is effectively applicable to an a.c. corona charger which is used for neutralizing purpose or a d.c. corona charger which is employed in substitution for or in combination with a transfer roller.

What is claimed is:

1. An electrophotographing copying apparatus in which an electrostatic latent image is formed on a charge retaining member carried by a conductive member and is developed with toner to provide a toner image, which image is transferred onto a record sheet by transfer means connected to a transfer bias source which has its terminal of the same polarity as the polarity to which the toner is charged connected to the conductive member, comprising:

a corona charger disposed in opposing relationship with the charge retaining member, a high tension source to cause a corona discharge from the corona charger, the high tension source having a first terminal connected to the conductive member and a second terminal connected to a corona discharge wire of the corona charger, said transfer bias source connected between said first terminal and the ground, said arrangement causing a corona current from the corona charger to flow between said conductive member and said first terminal and to bypass said transfer bias source.

2. An electrophotographic copying apparatus according to claim 1 in which the corona charger comprises a Scorotron charger.

* * * * *

UNITED STATES PATENT AND TRADEMARK OFFICE

CERTIFICATE OF CORRECTION

PATENT NO. : 4,415,254

DATED : November 15, 1983

INVENTOR(S) : Nishikawa

It is certified that error appears in the above—identified patent and that said Letters Patent is hereby corrected as shown below:

Column 1:

Line 25, change "a" to --a--;

Line 37, change "b" to --b--.

Column 7:

Line 10, change "sensitivity" to --resistivity--.

Signed and Sealed this

*Fourteenth* Day of *February 1984*

[SEAL]

*Attest:*

GERALD J. MOSSINGHOFF

*Attesting Officer*

*Commissioner of Patents and Trademarks*